US007044574B2

(12) United States Patent
Croley et al.

(10) Patent No.: US 7,044,574 B2
(45) Date of Patent: May 16, 2006

(54) METHOD AND APPARATUS FOR GENERATING AND ASSIGNING A CARTRIDGE IDENTIFICATION NUMBER TO AN IMAGING CARTRIDGE

(75) Inventors: Donald Fred Croley, Georgetown, KY (US); Mark Walter Fagan, Lexington, KY (US); Brian Thomas Jones, Lexington, KY (US); Randall David Mayo, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/331,237

(22) Filed: Dec. 30, 2002

(65) Prior Publication Data

US 2004/0125165 A1 Jul. 1, 2004

(51) Int. Cl.
*B41J 29/393* (2006.01)

(52) U.S. Cl. ..... 347/19

(58) Field of Classification Search ..... 347/19, 347/12, 86; 399/12

See application file for complete search history.

(56) References Cited

U.S. PATENT DOCUMENTS

| | | | | |
|---|---|---|---|---|
| 5,049,898 | A | | 9/1991 | Arthur et al. |
| 5,528,269 | A | * | 6/1996 | Drogo et al. ..... 347/19 |
| 5,610,635 | A | | 3/1997 | Murray et al. |
| 5,646,660 | A | | 7/1997 | Murray |
| 5,682,183 | A | | 10/1997 | Wade et al. |
| 5,682,184 | A | | 10/1997 | Stephany et al. |
| 5,691,750 | A | | 11/1997 | Edwards |
| 5,694,156 | A | | 12/1997 | Hoisington et al. |
| 5,711,619 | A | | 1/1998 | Kaneko et al. |
| 5,712,666 | A | | 1/1998 | Matsubara et al. |
| 5,812,156 | A | | 9/1998 | Bullock et al. |
| 5,966,144 | A | | 10/1999 | Edwards |
| 5,987,562 | A | | 11/1999 | Glover |
| 5,992,975 | A | | 11/1999 | Gasvoda et al. |
| 5,997,120 | A | | 12/1999 | Ohde et al. |
| 6,000,773 | A | | 12/1999 | Murray et al. |
| 6,007,173 | A | | 12/1999 | DeLouise et al. |
| 6,019,449 | A | | 2/2000 | Bullock et al. |
| 6,019,461 | A | | 2/2000 | Yoshimura et al. |
| 6,022,094 | A | | 2/2000 | Gibson et al. |
| 6,039,430 | A | | 3/2000 | Helterline et al. |
| 6,062,669 | A | | 5/2000 | Lee |
| 6,065,824 | A | | 5/2000 | Bullock et al. |
| 6,070,958 | A | | 6/2000 | Kanome |
| 6,089,687 | A | | 7/2000 | Helterline |
| 6,109,721 | A | | 8/2000 | Kim |
| 6,126,265 | A | | 10/2000 | Childers et al. |
| 6,145,947 | A | | 11/2000 | Inora et al. |
| 6,155,664 | A | | 12/2000 | Cook |
| 6,161,916 | A | | 12/2000 | Gibson et al. |
| 6,188,413 | B1 | | 2/2001 | Kang |
| 6,193,350 | B1 | | 2/2001 | Hadley |

(Continued)

FOREIGN PATENT DOCUMENTS

JP 2001-331306 * 11/2001

*Primary Examiner*—Stephen Meier
*Assistant Examiner*—Julian D. Huffman
(74) *Attorney, Agent, or Firm*—Taylor & Aust, P.C.

(57) ABSTRACT

An imaging system includes an imaging cartridge, a first memory associated with the imaging cartridge, and a controller communicatively coupled to the first memory. The controller executes program instructions for performing the steps of generating a generated cartridge identification number to be associated with the imaging cartridge and storing the generated cartridge identification number in the first memory.

6 Claims, 4 Drawing Sheets

U.S. PATENT DOCUMENTS 6,224,184 B1 5/2001 Imanaka et al.
6,227,643 B1 5/2001 Purcell et al.
6,234,603 B1 5/2001 Altfather et al.
6,290,321 B1 9/2001 Murray et al.
6,312,083 B1 11/2001 Moore
6,338,539 B1 1/2002 Kobayashi et al.
6,351,618 B1 * 2/2002 Pollocks, Jr. ..... 399/12
6,360,174 B1 3/2002 Shoki
6,361,164 B1 3/2002 Sansone
6,371,588 B1 4/2002 Tsuruoka
6,374,354 B1 * 4/2002 Walmsley et al. ..... 713/167
6,375,298 B1 4/2002 Purcell et al.
6,406,120 B1 6/2002 Pauschinger
6,409,302 B1 6/2002 Altfather et al.
6,568,785 B1 * 5/2003 Edelen et al. ..... 347/19
6,575,548 B1 * 6/2003 Corrigan, III et al. ..... 347/19
6,705,694 B1 * 3/2004 Barbour et al. ..... 347/9
2001/0009429 A1 7/2001 Soto et al.
2001/0038398 A1 11/2001 Kitahara
2002/0001010 A1 1/2002 Abe
2002/0051021 A1 5/2002 Mochizuki et al.
2002/0085847 A1 7/2002 Yoshida et al.

* cited by examiner

METHOD AND APPARATUS FOR GENERATING AND ASSIGNING A CARTRIDGE IDENTIFICATION NUMBER TO AN IMAGING CARTRIDGE

BACKGROUND OF THE INVENTION

1. Field of the Invention

The present invention relates to an imaging apparatus, and, more particularly, to method and apparatus for generating and assigning a cartridge identification number to an imaging cartridge.

2. Description of the Related Art

Many imaging apparatus, such as for example an ink jet printer or an electrophotographic (EP) printer, utilize some type of imaging cartridge that includes a supply of imaging substance, such as ink or toner. Some of such imaging cartridges include a memory unit that includes a manufacturer generated identification number that is unique to a particular imaging cartridge. This identification number is used to associate certain printing information with a particular cartridge. Because each number is unique, the number of unique identification numbers may be large, requiring for example, a memory unit having a capacity large enough to store a relatively large unique identification number, as well as associated cartridge usage information.

What is needed in the art is a method and apparatus for generating and assigning a cartridge identification number to an imaging cartridge that does not require a large amount of memory capacity for storing the cartridge identification number.

SUMMARY OF THE INVENTION

The present invention provides a method and apparatus for generating and assigning a cartridge identification number to an imaging cartridge that, for example, does not require a large amount of memory capacity for storing the cartridge identification number.

The present invention, in one form thereof, is directed to an imaging system. The imaging system includes an imaging cartridge, a first memory associated with the imaging cartridge, and a controller communicatively coupled to the first memory. The controller executes program instructions for performing the steps of generating a generated cartridge identification number to be associated with the imaging cartridge and storing the generated cartridge identification number in the first memory.

In another form thereof, the present invention is directed to an imaging apparatus. The imaging apparatus includes a controller that executes program instructions for performing the step of generating a cartridge identification number to be associated with an imaging cartridge.

In still another form thereof, the present invention is directed to a method for use with an imaging device. The method includes the steps of determining whether an imaging cartridge has a previously assigned cartridge identification number, wherein if the determining step yields a result of NO, then generating a generated cartridge identification number and assigning the generated cartridge identification number to the imaging cartridge, and wherein if the determining step yields a result of YES, then comparing the previously assigned cartridge identification number to entries in a cartridge ID registry for an imaging apparatus to determine if the previously assigned cartridge identification number is new to the imaging apparatus.

An advantage of the present invention is that a large amount of memory capacity for storing the cartridge identification number in the memory of the imaging cartridge is not required.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
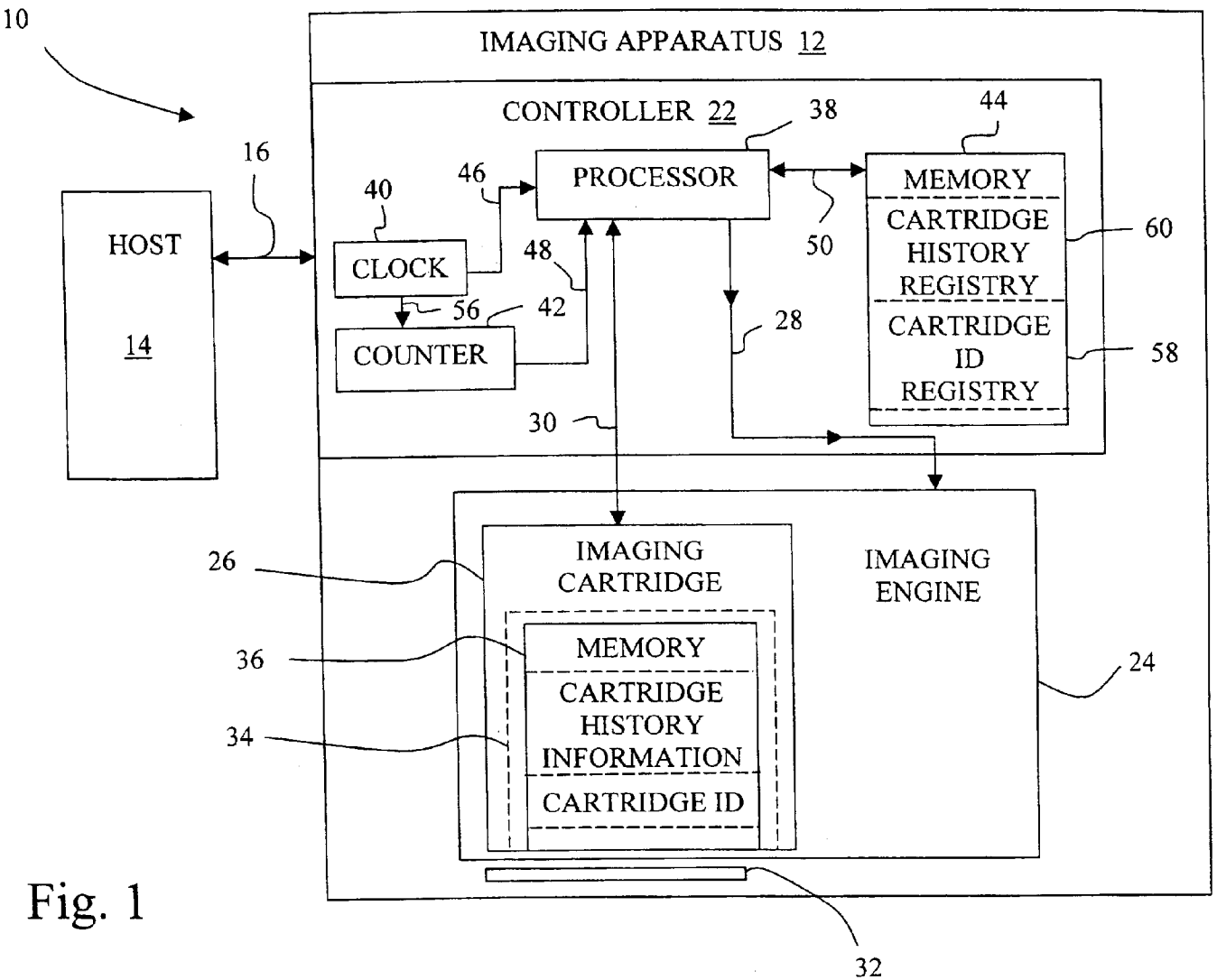
FIG. 1 is a diagrammatic representation of an imaging system implementing the present invention.

Referring now to the drawings, and particularly to FIG. 1, there is shown a diagrammatic depiction of an imaging system 10 for implementing the present invention. System 10 includes an imaging apparatus 12 and a host 14. Imaging apparatus 12 communicates with host 14 via a communications link 16.

Host 14 may be, for example, a personal computer including a monitor, an input device (e.g., keyboard), a processor, a memory device, including RAM and ROM, and a storage device, such as a hard drive, CD-ROM and/or DVD units. Resident in storage device is a software program that includes program instructions that function as an imaging driver, e.g., a printer driver, for communicating formatted imaging data and imaging commands to imaging apparatus 12. To effect imaging operations, the imaging driver is transferred to the computer's memory for working access by the computer's processor.

Imaging apparatus 12 includes a controller 22, and an imaging engine 24 that receives an imaging cartridge 26. Controller 22 communicates with imaging engine 24 via a communications link 28. Controller 22 communicates with imaging cartridge 26 via a communications link 30. Imaging apparatus 12 can be, for example, an ink jet printer and/or copier, or an electrophotographic printer and/or copier.

In the context of the examples for imaging apparatus 12 given above, imaging engine 24 can be, for example, an ink jet printing unit or an electrophotographic printing unit. For example, such an ink jet printing unit may include a reciprocating carriage for carrying imaging cartridge 26. As a further example, such an electrophotographic printing unit may include an imaging head having a laser light source and an associated rotating multifaceted mirror for scanning a laser beam over a photoconductive member.

Depending on the type of imaging engine 24, e.g., an ink jet printing unit or an electrophotographic printing unit, an appropriate type of imaging cartridge 26 will be received in and associated therewith. Imaging cartridge 26 can be, for example, an ink supply tank, an ink jet cartridge, a toner tank, or an electrophotographic process (EP) cartridge, each of which contains a supply of an imaging substance, such as for example ink or toner, that is consumed during an imaging process. Imaging apparatus 12 uses the imaging substance contained in imaging cartridge 26 to form an image on a sheet of print media 32. The sheet of print media 32 can be, for example, paper, fabric or transparency.

If imaging cartridge 26 is of the ink jet cartridge type, a printhead 34 shown in dashed lines, is included integral with the imaging substance supply. Printhead 34 includes a nozzle plate attached over a silicon chip that includes ink ejection chambers, each chamber including a corresponding ink ejection actuator, the configuration of which is well known in the ink jet printer art. Such an ink ejection actuator may be, for example, an electric heater element or a piezoelectric element.

Imaging cartridge 26 has mounted thereto a memory 36 having memory locations for storing information relating to imaging cartridge 26. By attaching memory 36 to imaging cartridge 26, information stored therein can travel with imaging cartridge 26 from one imaging apparatus to another. Where imaging cartridge 26 is an ink jet cartridge having printhead 34, memory 36 may be contained on the same silicon substrate of printhead 34 as the ink ejection actuators or, alternatively, formed as a separate silicon chip and attached to the body of imaging cartridge 26.

The information relating to imaging cartridge 26 may include, for example, a cartridge identification number and cartridge history information. Such cartridge history information may include, for example, imaging substance information, e.g., ink type, toner type, initial supply amount, etc.; alignment data; and/or a value representing an amount of usage of imaging cartridge 26, such as a dot count.

If, for example, imaging cartridge 26 is an ink jet cartridge, the dot count may be representative of the number of ink droplets ejected from the ink jet cartridge, and in turn the number of ink dots formed on the sheet of print media; further, the alignment data may represent values used to compensate for ink jet printhead skew.

If, as a further example, imaging cartridge 26 is an electrophotographic process (EP) cartridge, the dot count may be representative of the number of times the laser beam was pulsed on, and in turn the number of toner dots formed on a photoconductive member contained in the electrophotographic process (EP) cartridge; further, the alignment data may be associated with an orientation of the photoconductive member relative to the scan path of the laser beam.

In one configuration of memory 36 of imaging cartridge 26, for example, six bits may be reserved for the imaging cartridge identification number, which is set by imaging apparatus 12 in accordance with the present invention. Thus, at the cartridge identification number memory location in memory 36, six bits provide up to 63 possible identification numbers, excluding the initial non-programmed value. The number of unique identification numbers may be expanded by increasing the number of bits for the imaging cartridge identification number; for example, at the cartridge ID memory location in memory 36, eight bits would yield 255 possible identification numbers, excluding the initial non-programmed value. The cartridge history information stored in memory 36 may include, for example, sixteen bits used for alignment data. The cartridge history information stored in memory 36 may further include a predetermined number of bits, for example sixteen bits, used as a coarse dot count counter, wherein for example, each bit represents a scaling factor of 50 million dots.

Controller 22 includes a processor 38, a clock 40, a counter 42, and a memory 44 that are communicatively coupled. Processor 38 is communicatively coupled to clock 40 via communications link 46. Processor 38 is communicatively coupled to counter 42 via communications link 48. Processor 38 is communicatively coupled to memory 44 via communications link 50. Processor 38 is further communicatively coupled to imaging engine 24 via communications link 28, and to imaging cartridge 26 via communications link 30.

Processor 38 may include, for example, a microprocessor, random access memory (RAM), and read only memory (ROM). Controller 22 executes program instructions via processor 38 for forming an image on the sheet of print media 32 via imaging engine 24 and imaging cartridge 26. Controller 22 further executes program instructions via processor 38 for performing the method of the present invention, including reading data or writing data to memory 36 of imaging cartridge 26 via communications link 30, and for reading data or writing data to memory 44 of imaging apparatus 12 via communications link 50.

Clock 40 is a system clock that operates, for example, at a clocking rate of 100 MHz. Clock 40 is coupled to counter 42 via communications link 56. Counter 42 is a re-circulating counter that is used to generate a cartridge identification number for use as the cartridge identification number for imaging cartridge 26. By the term, "re-circulating", it is meant that the count of counter 42 wraps around to continue counting, in a sequence such as, for example, 1, 2, 3, 4, 5, 1, 2, 3, 4, 5, 1, 2 . . . . The counting range of counter 42 is selected to correspond to, or exceed, the number of bits used for the cartridge identification number, thereby providing a plurality of possible cartridge identification numbers. If, for example, the cartridge identification number is a six bit number, then the usable counting range of counter 42 for providing unique cartridge identification numbers may be, for example, one (1) through sixty-three (63), or alternatively, zero (0) through sixty-two (62), with one number being excluded which corresponds to the initial non-programmed state in the cartridge ID memory location in memory 36. The count of counter 42 is triggered by the clock input received from clock 40 via communications link 56.

Alternatively, it is contemplated that a counter may be executed in software executed on processor 38 of imaging apparatus 12, or executed in controller software executed by host 14 and supplied to imaging apparatus 12.

Memory 44 includes a cartridge ID registry 58 and a cartridge history registry 60. Cartridge ID registry 58 includes a plurality of memory locations for storing a predetermined number of cartridge identification numbers corresponding to the current and previously used imaging cartridges. For example, cartridge ID registry 58 may include memory capacity to store the cartridge identification number of the current imaging cartridge 26 as well as the previous three imaging cartridges. As a further example, cartridge ID registry 58 may include memory capacity to store the cartridge identification number for the current imaging cartridge 26, and the previous cartridge identification number for each of several different types of imaging cartridges, such as for example, full strength ink cartridges, dilute ink cartridges, photo quality cartridges, etc.

Cartridge history registry 60 maintains separate cartridge history information corresponding to each cartridge identification number stored in cartridge ID registry 58. Some of the cartridge history information, such as alignment information and cartridge type information, may replicate that which was stored in the cartridge history information of memory 36 of imaging cartridge 26. Other information, such as the dot count, may differ. For example, since the memory size constraints for memory 44 of imaging apparatus 12 are not as stringent as that of memory 36 of imaging cartridge 26, i.e., memory 36 has a relatively small memory capacity in comparison to memory 44, memory 44 of imaging apparatus 12 can maintain a fine dot count that counts each dot formed using a particular imaging cartridge 26. When controller 22 determines that the fine dot count maintained in memory 44 for the current imaging cartridge 26 has reached a predetermined count threshold, for example at each 50 million dots, then controller 22 will update the coarse dot count maintained in the cartridge history information stored in memory 36 of imaging cartridge 26.

Figure 2A:
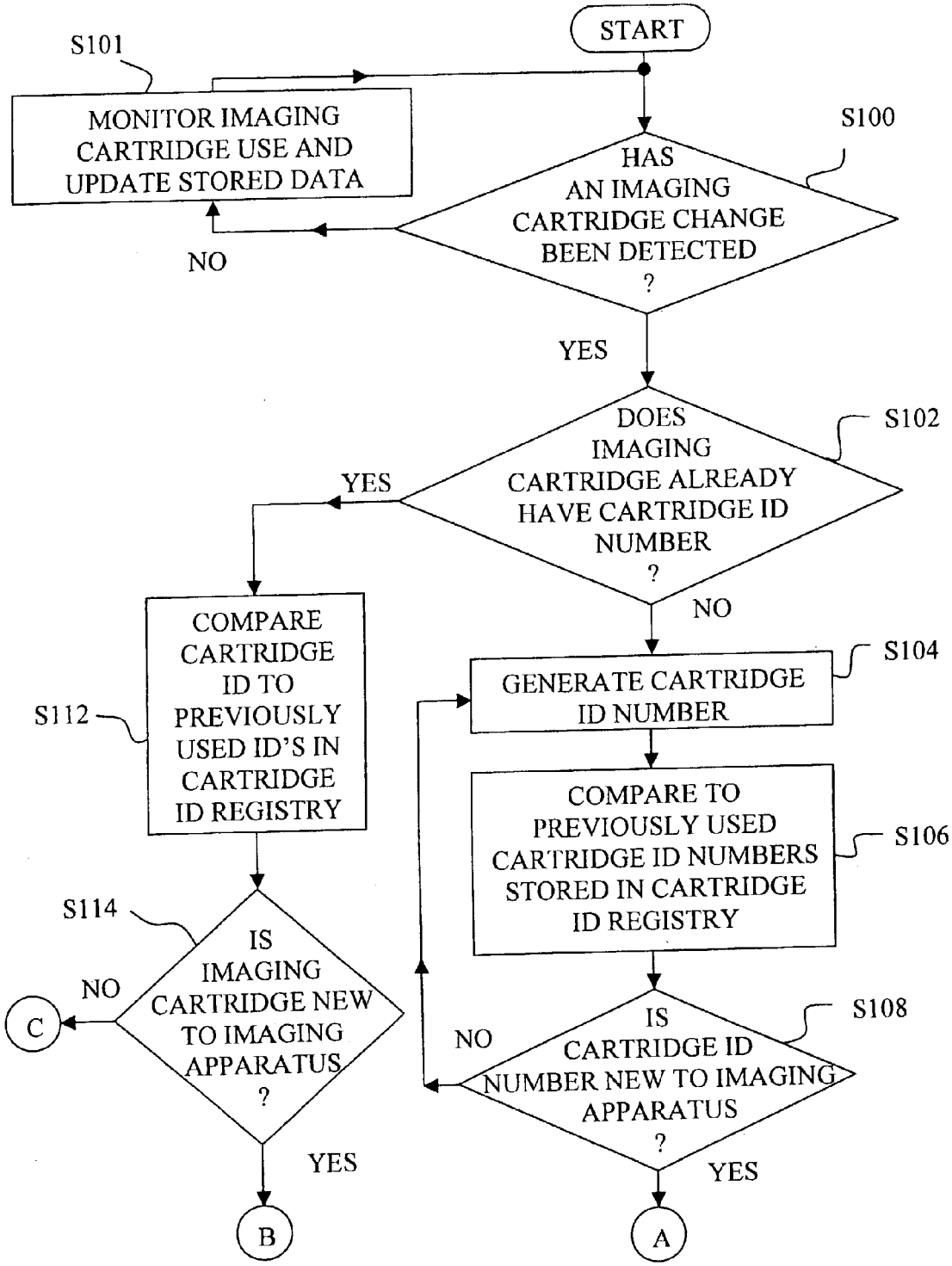
FIG. 2A and FIG. 2B represent a flowchart depicting a method of the present invention implemented by the imaging system of FIG. 1.
Figure 2B:
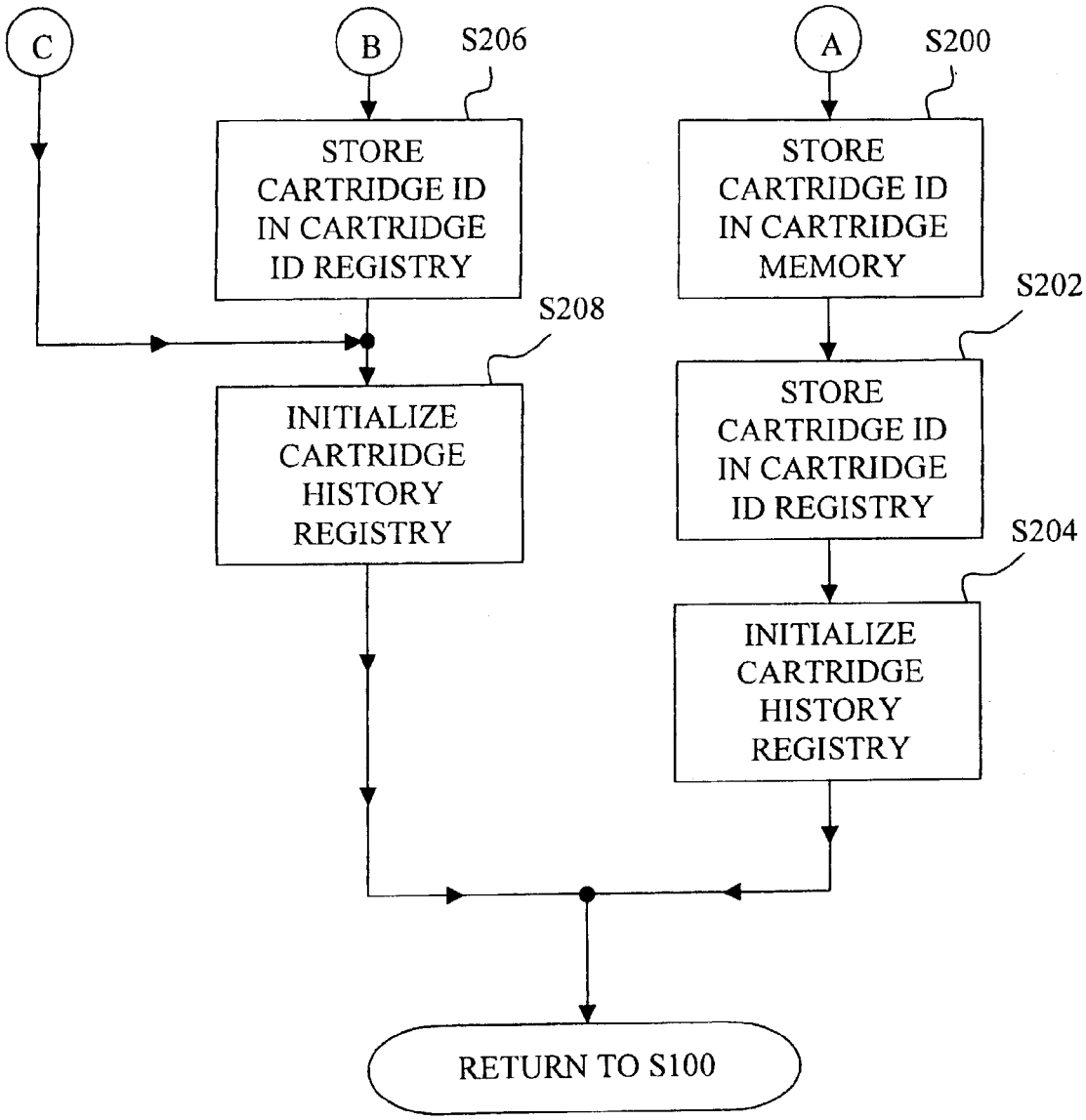

FIG. 2A and FIG. 2B represent a flowchart depicting a method of the present invention implemented by imaging apparatus 12 of imaging system 10. In the implementation described below, controller 22 executes program instructions for performing the steps of the method depicted in FIGS. 2A and 2B. During the description of the method of the invention that follows, occasional reference will be made to various components shown in FIG. 1.

At step S100, it is determined whether an imaging cartridge change has been detected. This determination may be made, for example, by the detection by controller 22 of the loss of communications with memory 36 of imaging cartridge 26, followed by the re-establishment of the communications with memory 36.

If the result of step S100 is NO, then the process proceeds to step S101.

At step S101, controller 22 monitors the use of imaging cartridge 26 by imaging apparatus 12, and accordingly updates the memory contents of the corresponding memory locations in cartridge history registry 60 of memory 44, and updates the cartridge history information in memory 36 of imaging cartridge 26. Thereafter, the process returns to step S100.

If the result of step S100 is YES, then the process proceeds to step S102.

At step S102, it is determined whether the detected imaging cartridge 26 already has a cartridge identification number, i.e., whether a cartridge identification number was previously assigned to imaging cartridge 26. This step is achieved, for example, by controller 22 reading the cartridge ID location in memory 36 of imaging cartridge 26. If it is determined that the cartridge memory location has never been changed from its original setting, then the outcome of the determination at step S102 is NO, and it is assumed that the detected imaging cartridge 26 is new and has not been assigned a cartridge identification number. On the other hand, if it is determined that the cartridge memory location has been changed from its original setting, then the outcome of the determination at step S102 is YES, and it is assumed that the detected imaging cartridge 26 previously has been assigned a cartridge identification number. In one preferred implementation of the present invention, at least the cartridge ID location in memory 36 is a write-once memory, having electrical characteristics similar to that of an electrically programmable read only memory (EPROM).

If the determination at step S102 is NO, then the process proceeds to step S104, wherein a cartridge identification number for imaging cartridge 26 is generated. In one preferred implementation of the present invention, the cartridge identification number is randomly generated by imaging apparatus 12. For example, re-circulating counter 42 is continually running based on trigger signals received from clock 40. Processor 38 selects a current count from counter 42 of which its entirety, or a portion thereof, will potentially be used as the cartridge identification number for imaging cartridge 26. Thus, in essence, processor 38 performs a random selection of a cartridge identification number from a plurality of possible cartridge identification numbers.

At step S106, the generated cartridge identification number is compared to the cartridge identification numbers stored in cartridge ID registry 58 of memory 44.

At step S108, it is determined whether the generated cartridge identification number is new to imaging apparatus 12. Based on the outcome of the comparison at step S106, if the generated cartridge identification number is equal to one of the cartridge identification numbers stored in cartridge ID registry 58, the generated cartridge identification number is not new to imaging apparatus 12, the result of the determination at step S108 is NO, and the process returns to step S104 to generate a new cartridge identification number. Otherwise, the result of the determination at step S108 is YES, and the process proceeds to step S200 (see FIG. 2B).

At step S200, the generated cartridge identification number is assigned to imaging cartridge 26 by storing the generated cartridge identification number in the cartridge ID location in memory 36 of imaging cartridge 26. The process then proceeds to step S202.

At step S202, the generated cartridge identification number is stored in a vacant memory location in cartridge ID registry 58 of memory 44 of imaging apparatus 12. If all memory locations in cartridge ID registry 58 are occupied, then one of the previous entries is written-over with the generated cartridge identification number. For example, if memory 44 tracks the previous four imaging cartridges installed in imaging apparatus 12 without regard to imaging cartridge type, then the oldest of the previous cartridge identification numbers will be replaced.

At step S204, the corresponding memory locations in cartridge history registry 60 are initialized with the cartridge history information stored in memory 36 of imaging cartridge 26. Thus, since imaging cartridge 26 is considered a new cartridge, the cartridge history information stored in memory 36 is non-existent and the corresponding memory locations in cartridge history registry 60 of memory 44 of imaging apparatus 12 are initialized to starting values, such as by clearing, e.g., by writing zeros to, the corresponding memory locations in cartridge history registry 60.

The process then returns to step S100.

If at step S102 the outcome of the determination is YES, then the process proceeds to step S112. At step S112, the previously assigned cartridge identification number that was read from memory 36 of imaging cartridge 26 is compared to the cartridge identification numbers stored in cartridge ID registry 58 of memory 44.

At step S114, it is determined whether the read previously assigned cartridge identification number is new to imaging apparatus 12, i.e., whether imaging cartridge 26 is new to imaging apparatus 12. If YES, the process proceeds to step S206. If NO, then the process proceeds to step S208.

At step S206, the read previously assigned cartridge identification number is stored in a vacant memory location in cartridge ID registry 58 of memory 44 of imaging apparatus 12. If all memory locations in cartridge ID registry 58 are occupied, then one of the previous entries is written-over with the read cartridge identification number. For example, if memory 44 tracks the previous four imaging cartridges installed in imaging apparatus 12 without regard to imaging cartridge type, then the oldest of the previous cartridge identification numbers will be replaced.

At step S208, the corresponding memory locations in cartridge history registry 60 of memory 44 of imaging apparatus 12 are initialized based on the cartridge history information stored in memory 36 of imaging cartridge 26. For example, the dot count memory locations in cartridge history registry 60 corresponding to the particular cartridge identification number being considered may be modified based on the coarse dot count stored in memory 36 of imaging cartridge 26. Such a modification can occur, for example, by retrieving the actual dot count from cartridge history registry 60, subtracting the previous dot count threshold to form a remainder, adding the remainder to the coarse dot count read from cartridge memory 36 to form a dot sum, and then storing the dot sum as the current dot count in cartridge history registry 60 of memory 44. By the term "previous dot count threshold" it is meant the closest product of a coarse dot count multiplied by the scale factor (e.g., coarse dot count times 50 million) that is less than the actual dot count that was stored in cartridge history registry 60 of memory 44 corresponding to that particular cartridge identification number.

Thereafter, the process returns to the loop of steps S100 and S101 to monitor whether an imaging cartridge change has been detected and to monitor the use of imaging cartridge 26 by imaging apparatus 12, and accordingly update the memory contents of the corresponding memory locations in cartridge history registry 60, and update the cartridge history information in memory 36 of imaging cartridge 26, as a result of the imaging by imaging apparatus 12 using imaging cartridge 26.

Figure 3:
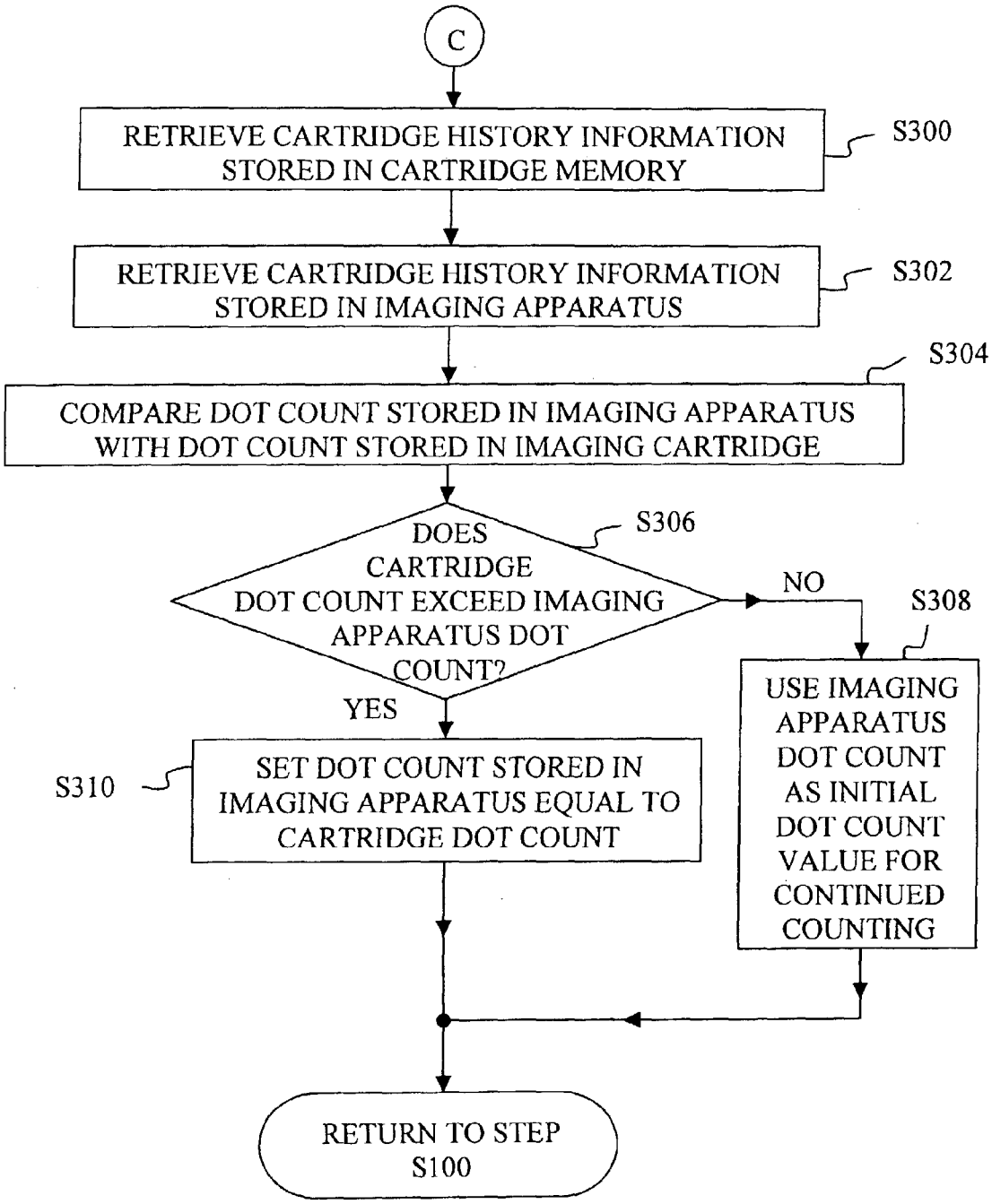
FIG. 3 represents a flowchart depicting alternative method steps that branch from step S114 of FIG. 2A.

As an alternative method of the invention, if at step S114, it is determined that the read cartridge identification number is not new to imaging apparatus 12, the process may alternatively proceed to process step S300 of FIG. 3.

At step S300, cartridge history information stored in memory 36 of imaging cartridge 26 is retrieved by controller 22. The retrieved cartridge history information may include, for example, the stored dot count.

At step S302, cartridge history information corresponding to the cartridge identification number of imaging cartridge 26 is retrieved from cartridge history registry 60. The retrieved cartridge history information may include, for example, the stored dot count.

At step S304, the dot count stored in cartridge history registry 60 of memory 44 of imaging apparatus 12 is compared to the dot count stored in memory 36 of imaging cartridge 26.

At step S306, it is determined whether the dot count stored in memory 36 of imaging cartridge 26 exceeds the corresponding dot count stored in memory 44 of imaging apparatus 12.

If the result of the determination at step S306 is NO, the process proceeds to step S308, wherein the dot count stored in imaging apparatus 12 is used as the initial dot count value for continued counting, and the corresponding dot count in memory 36 is updated, if appropriate.

If the result of the determination at step S306 is YES, the process proceeds to step S310, wherein the corresponding dot count stored in cartridge history registry 60 of memory 44 of imaging apparatus 12 is set to the dot count stored in memory 36 of imaging cartridge 26.

Thereafter, process returns to step S100.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for use with an imaging device, comprising the steps of:

determining whether an imaging cartridge has a previously assigned cartridge identification number, wherein if said determining step yields a result of NO, then generating a generated cartridge identification number and assigning said generated cartridge identification number to said imaging cartridge, and wherein if said determining step yields a result of YES, then comparing said previously assigned cartridge identification number to entries in a cartridge ID registry for an imaging apparatus to determine if said previously assigned cartridge identification number is new to said imaging apparatus.

2. The method of claim 1, wherein if it is determined that said previously assigned cartridge identification number is new to said imaging apparatus, then performing the further steps of:

storing said previously assigned cartridge identification number in a memory location in said cartridge ID registry; and initializing corresponding memory locations in a cartridge history registry for said imaging apparatus based on cartridge history information stored in a memory of said imaging cartridge.

3. The method of claim 1, further comprising the step of initializing memory locations in a cartridge history registry corresponding to said previously assigned cartridge identification number.

4. The method of claim 3, wherein said initializing step comprises the steps of modifying a dot count stored in said cartridge history registry based on a coarse dot count stored in a cartridge memory of said imaging cartridge.

5. The method of claim 1, wherein if it is determined that said previously assigned cartridge identification number is not new to said imaging apparatus, then performing the further steps of:

determining whether a dot count stored in a cartridge memory of said imaging cartridge exceeds a corresponding dot count stored in a cartridge history registry for said imaging apparatus, wherein if it is determined that said dot count stored in said cartridge memory of said imaging cartridge does not exceed said corresponding dot count stored in said cartridge history registry, then said corresponding dot count stored in said cartridge history registry is used as an initial dot count value for continued counting with respect to said imaging cartridge.

6. The method of claim 1, wherein if it is determined that said previously assigned cartridge identification number is not new to said imaging apparatus, then performing the further steps of:

determining whether a dot count stored in a cartridge memory of said imaging cartridge exceeds a corresponding dot count stored in a cartridge history registry for said imaging apparatus, wherein if it is determined that said dot count stored in said cartridge memory of said imaging cartridge does exceed said corresponding dot count stored in said cartridge history registry, then setting said corresponding dot count stored in said cartridge history registry to said dot count stored in said cartridge memory of said imaging cartridge.

* * * * *